US008294369B1

(12) United States Patent
Laroussi

(10) Patent No.: US 8,294,369 B1
(45) Date of Patent: Oct. 23, 2012

(54) LOW TEMPERATURE PLASMA GENERATOR HAVING AN ELONGATE DISCHARGE TUBE

(75) Inventor: Mounir Laroussi, Virginia Beach, VA (US)

(73) Assignee: Old Dominion University, Norfolk, VA (US)

( * ) Notice: Subject to any disclaimer, the term of this patent is extended or adjusted under 35 U.S.C. 154(b) by 510 days.

(21) Appl. No.: 12/583,277

(22) Filed: Aug. 18, 2009

Related U.S. Application Data

(60) Provisional application No. 61/215,351, filed on May 4, 2009.

(51) Int. Cl.
*H01J 7/24* (2006.01)

(52) U.S. Cl. ..... 315/111.21; 315/109; 315/111.91; 313/231.31

(58) Field of Classification Search ..... 315/111.01, 315/111.21, 111.81, 111.91, 108, 109; 313/231.01, 313/231.31
See application file for complete search history.

(56) References Cited

U.S. PATENT DOCUMENTS 4,782,235 A * 11/1988 Lejeune et al. ..... 250/423 R
6,124,675 A * 9/2000 Bertrand et al. ..... 315/111.91
6,805,779 B2 * 10/2004 Chistyakov ..... 204/298.36

* cited by examiner

*Primary Examiner* — James H Cho
(74) *Attorney, Agent, or Firm* — Wooten & Shaddock, PLC

(57) ABSTRACT

A plasma generator for delivering a generated plasma to an area that is a distance from the area where the plasma is initially generated, including a dielectric tube portion extending from a gas inlet to a discharge aperture; an anode formed at least substantially around a portion of the discharge tube, wherein the anode is electrically coupled, via an electrical connection, to a power supply; a cathode formed at least substantially around a portion of the discharge tube, wherein the cathode is electrically coupled, via an electrical connection, to the power supply; and an elongate discharge tube attached or coupled to the discharge aperture such that when a generated plasma is produced, the generated plasma flows through the discharge tube.

27 Claims, 12 Drawing Sheets

LOW TEMPERATURE PLASMA GENERATOR HAVING AN ELONGATE DISCHARGE TUBE

CROSS-REFERENCE TO RELATED APPLICATIONS

This nonprovisional patent application claims the benefit of U.S. Provisional Patent Application Ser. No. 61/215,351, filed May 4, 2009 the disclosure of which is incorporated herein by reference.

BACKGROUND OF THE INVENTION

1. Field of the Invention

This invention is drawn generally to plasma generators. In particular, the present invention is drawn to plasma generators having an elongate discharge tube.

2. Description of Related Art

Non-thermal plasmas, or "cold plasmas", at or near atmospheric pressures have recently received increased attention because of their use in several emerging novel applications such as excimer light sources, the surface modification of polymers, the biological and chemical decontamination of media, and other medical applications.

SUMMARY OF THE INVENTION

The present invention relates generally to plasma generators. In particular, the present invention is drawn to plasma generators capable of producing a plasma plume or jet in open room air and propagating the plasma plume through an elongate discharge tube.

This method is based on the use of a cold plasma jet, generated by a plasma generator capable of emitting a low temperature plasma plume, jet, or discharge through an elongate discharge tube. In various exemplary, nonlimiting embodiments of the present invention, a plasma generator, as described in more detail herein, is utilized to produce the appropriate plasma plume, jet, or discharge through a discharge tube aperture of the elongate discharge tube. Thus, the generated plasma can be delivered to an area that is a distance from the area where the plasma is initially generated.

In certain exemplary embodiments, the plasma generator of the present invention is utilized to propagate a plasma plume or discharge through an elongate tube to disinfect or sterilize the interior of the tube. Thus, the plasma generator of the present invention can be utilized to disinfect or sterilize tubes of varying lengths and inner diameters.

Non-thermal plasmas, or "cold plasmas", at or near atmospheric pressures have recently received increased attention because of their use in several emerging novel applications such as excimer light sources, the surface modifications of polymers, the biological and chemical decontamination of media, and other medical applications. Generating plasma in open room air adds the advantage of eliminating the need for an enclosure. Due to the abundant presence of oxygen, nitrogen, and moisture in air, reactive chemical species are produced. Additionally, since the whole process is carried out at atmospheric pressure, no costly and impractical vacuum equipment is necessary.

The plasma generator of this invention is capable of producing a relatively relatively long plasma plume or jet in open room air. The generated plasma plume remains at room temperature and can be placed in contact with sensitive materials such as skin, flesh, paper, cloth, etc. without causing any damage. Another advantage of the plasma generator of this invention is its portability.

In various exemplary, non-limiting embodiments, the plasma generator having an elongate discharge tube, or "plasma generator", comprises a cylindrical dielectric tube with an aperture at one end formed so as to allow a generated plasma plume to exit the dielectric tube. An elongate discharge tube is permanently or removably attached or coupled within the aperture such that the generated plasma is propagated and migrates through the interior of the tube, until the generated plasma exits through the discharge tube aperture. If the discharge tube is flexible, the plasma generator can allow a discharge point for a generated plasma to be moved or manipulated so that the generated plasma can be applied as desired by a user.

In various exemplary embodiments, the plasma generator can be used in applications requiring localized and precise plasma-treatment of materials that cannot withstand the harsh treatment of wet chemicals, high temperatures, or mechanical pressure. The plasma generator provides a means for disinfection, sterilization, and/or precise cleaning of small surfaces, disinfection of skin or wounds, inactivation of dental bacteria, the removal of plaque, the whitening of teeth, disinfection of root canals, the coagulation of blood, and the like.

Accordingly, this invention provides a plasma generator, which can be used to provide a plasma discharge a distance from where the plasma is initially generated.

This invention separately provides a plasma generator, which can be used for inactivation of bacteria, and cleaning and/or sterilization of tools or instruments.

This invention separately provides a plasma generator, which can be used to sterilize or disinfect small diameter tubes.

This invention separately provides a plasma generator, which can be used to sterilize or disinfect the inner surface of tubes.

This invention separately provides a plasma generator, which is portable, scalable, environmentally safe, easy to use, and operates at a relatively low temperature.

This invention separately provides a plasma generator, which allows for the generation of a single cold plasma plume.

This invention separately provides a plasma generator, which allows for the generation of a series of patterned cold plasma plumes.

This invention separately provides a plasma generator, which generates one or more plasma plumes that can be placed in contact with sensitive materials such as skin, flesh, paper, cloth, etc. without causing any damage.

This invention separately provides a plasma generator for the modification of surfaces to make them more or less wettable (i.e. hydrophilic, hydrophobic).

This invention separately provides a plasma generator, which may be portable.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF THE PREFERRED EMBODIMENT

For simplicity and clarification, the design factors and operating principles of the plasma generator according to this invention are explained with reference to various exemplary embodiments of a plasma generator according to this invention. The basic explanation of the design factors and operating principles of the plasma generator is applicable for the understanding, design, and operation of the plasma generator of this invention.

Furthermore, it should be appreciated that, for simplicity and clarification, the embodiments of this invention will be described with reference to the plasma generator comprising circular dielectric disks and a cylindrical dielectric tube.

However, it should be appreciated that the dielectric disks and dielectric tube or tubes of this invention may comprise circular, oval, rectangular, square, pentagonal, or any other geometric shapes.

It should also be appreciated that the term "plasma generator" is for basic explanation and understanding of the operation of the methods and/or apparatuses of this invention. Therefore, the term "plasma generator" is not to be construed as limiting the methods and/or apparatuses of this invention.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding both of those included limits are also included in the invention.

Figure 1:
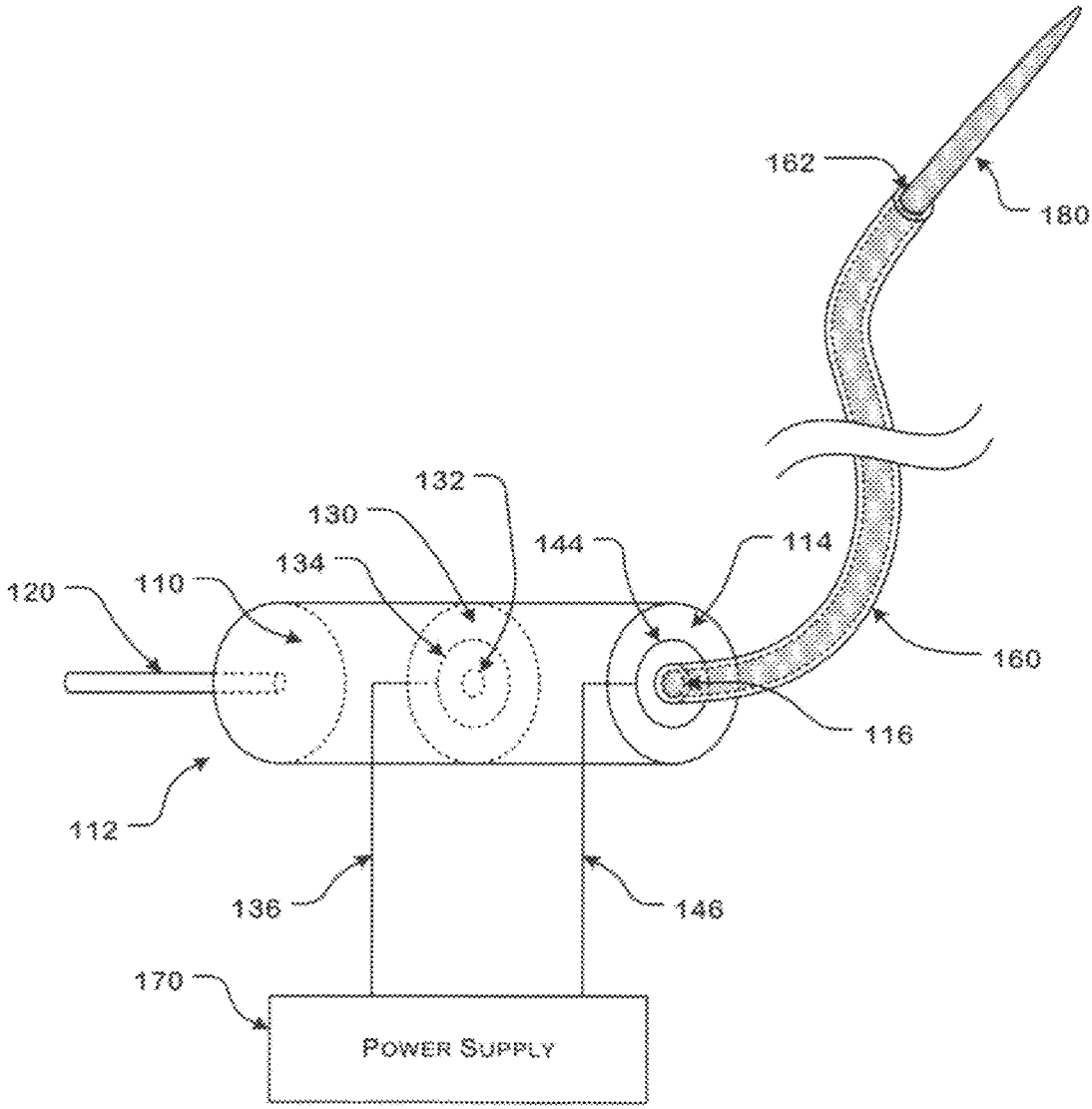
FIG. 1 shows a functional block diagram of a first illustrative, non-limiting embodiment of an exemplary plasma generator having an elongate discharge tube, according to this invention.

Turning now to FIG. 1, FIG. 1 shows a functional block diagram of a first illustrative, non-limiting embodiment of a plasma generator, according to this invention. As shown in FIG. 1, the plasma generator 100 comprises a dielectric tube portion 110 having a first wall portion 112 and a second wall portion 114. At least one anode and one cathode are placed or formed within or proximate a cavity of the dielectric tube portion 110. As illustrated, the second wall portion 114 may be constructed so as to form the cathode. However, it should be appreciated that the cathode may comprise a separate portion material that is distinct from the material that comprises the second wall portion 114.

The anode comprises a dielectric disk 130 having a dielectric aperture 132 formed therein. In various exemplary embodiments, the dielectric aperture 132 is formed proximate a center of the dielectric disk 130.

An anode 134 is attached or coupled to the dielectric disk 130 so as to at least partially surround the dielectric aperture 132. It should be appreciated that the anode 134 is attached or coupled to the dielectric disk 130 such that the anode 134 does not obstruct the dielectric aperture 132.

The anode 134 comprises an electrically conductive material, such as, for example, a metal. In various exemplary embodiments, the anode 134 may be embedded within the dielectric disk 130.

In various exemplary embodiments, a diameter of the anode 134 is smaller than a diameter of the dielectric disk 130, but is larger than a diameter of the dielectric aperture 132.

The anode 134 is electrically coupled, via an electrical connection 136, to a power supply 170.

Similarly, the second wall portion 114, which acts as a cathode, comprises a dielectric material having a discharge aperture 116, which acts as a second dielectric aperture, formed therein. In various exemplary embodiments, the discharge aperture 116 is formed proximate a center of the second wall portion 114.

A cathode 144 is attached or coupled to the second wall portion 114 so as to at least partially surround the discharge aperture 116. It should be appreciated that the cathode 144 is attached or coupled to the second wall portion 114 such that the cathode the cathode 144 does not obstruct the discharge aperture 116.

The cathode 144 comprises an electrically conductive material, such as, for example, a metal. In various exemplary embodiments, the cathode 144 may be embedded within the second wall portion 114.

In various exemplary embodiments, a diameter of the cathode 144 is smaller than a diameter of the second wall portion 114, but is larger than a diameter of the discharge aperture 116.

The cathode 144 is electrically coupled, via an electrical connection 146, to the power supply 170.

In various exemplary, non-limiting embodiments, at least a portion of the dielectric tube portion 110, the dielectric disk 130, and/or the second wall portion 114 may be formed of glass, plexiglass, quartz, alumina, ceramic, or the like. However, it should be appreciated that the material that comprises each dielectric disk and the material that comprises the dielectric tube portion may be the same material or may be a different material. It should also be appreciated that the dielectric tube portion 110, the dielectric disk 130, and/or the second wall portion 114 may be formed of multiple materials. Thus, it should be understood that the material or materials used to form the dielectric tube portion 110, the dielectric disk 130, and/or the second wall portion 114 is a design choice based on the desired appearance, strength, and functionality of the plasma generator 100.

In various exemplary, non-limiting embodiments, the first wall portion 112 of the dielectric tube portion 110 is sealed or closed, but for a gas inlet 120. The dielectric disk 130 is located within the cavity of the dielectric tube portion 110. The second wall portion 114 is located flush with the second end of the dielectric tube portion 110.

In various exemplary, non-limiting embodiments, the distance that separates the dielectric disk 130 from the second wall portion 114 is approximately 1-40 mm.

The elongate discharge tube 160 is permanently or removably attached or coupled within the discharge aperture 116 such that when a generated plasma 180 is produced, the plasma 180 flows through the discharge aperture 116 and the discharge tube 160. In various exemplary embodiments, the discharge tube 160 is formed of a substantially flexible, non-conductive material. Alternatively, the discharge tube 160 may be formed of a substantially rigid, non-conductive material.

Once the plasma generator 100 is constructed, a carrier gas (or mixture) is injected into the first wall portion 112 of the dielectric tube portion 110, via the gas inlet 120. In various exemplary embodiments, the carrier gas (or mixture) is injected into the plasma generator at a flow rate of approximately 1-10 l/min. In various exemplary, non-limiting embodiments, the gas or gas mixtures may comprise helium, helium and oxygen, argon, nitrogen, air, or the like.

As the carrier gas (or mixture) is injected into the gas inlet 120, the gas flows through the cavity of the dielectric tube portion 110, through the dielectric aperture 132 of the dielectric disk 130, through the discharge aperture 116 of the second wall portion 114, through the interior of the discharge tube 160, and finally through the discharge tube aperture 162.

When power is applied to the anode 134 and the cathode 144, the injected gas breaks down and a plasma plume 180 is discharged through the discharge aperture 116 of the second wall portion 114, through the interior of the discharge tube 160, and finally through the discharge tube aperture 162.

The generated plasma plume 180 generally extends approximately 2 inches or more from the discharge tube aperture 162. The width of the plasma plume 180 is generally determined by the diameter or size of the discharge tube aperture 162. In various exemplary embodiments, the diameter of the discharge tube aperture 162 is approximately 1 mm to a few millimeters.

If the discharge tube 160 is flexible, the plasma generator 100 allows a user to move or manipulated the discharge tube 160 so that the generated plasma plume 180 can be applied as desired by a user.

The generated plasma plume 180 is at room temperature and remains stable so long as appropriate power is applied to the anode 134 and the cathode 144 and the carrier gas is flowing.

In various exemplary, non-limiting embodiments, the power supply 170 can supply Alternating Current (AC), Radio Frequency (RF) power, or regulated voltage pulses of varying widths and of varying frequencies to the anode 134 and the cathode 144. In certain embodiments, the plasma generator 100 is driven by nanosecond/microsecond voltage pulses to, in turn, produce nanosecond/microsecond plasma plumes.

The power supply 170 may optionally supply the plasma generator 100 with a pulsed voltage having a magnitude from 2 kilovolts to 12 kilovolts, applied at a pulse width of between 200 nanoseconds to 5 microseconds, and/or applied at a frequency of 1 kilohertz to 10 kilohertz or higher.

In various exemplary, non-limiting embodiments, the power supply 170 supplies between 1-20 watts of power to the anode 134 and the cathode 144. It should be understood that, in various exemplary embodiments, the power supply 170 may supply up to several hundred watts of power to the anode 134 and the cathode 144, based on the desired strength, functionality, and/or size of the generated plasma plume 180 or the plasma generator 100. It should be appreciated that the frequency and amount of power supplied by the power supply 170 may be altered to produce a generated plasma plume 180 having a desired strength, functionality, size, and/or duration.

Figure 2A:
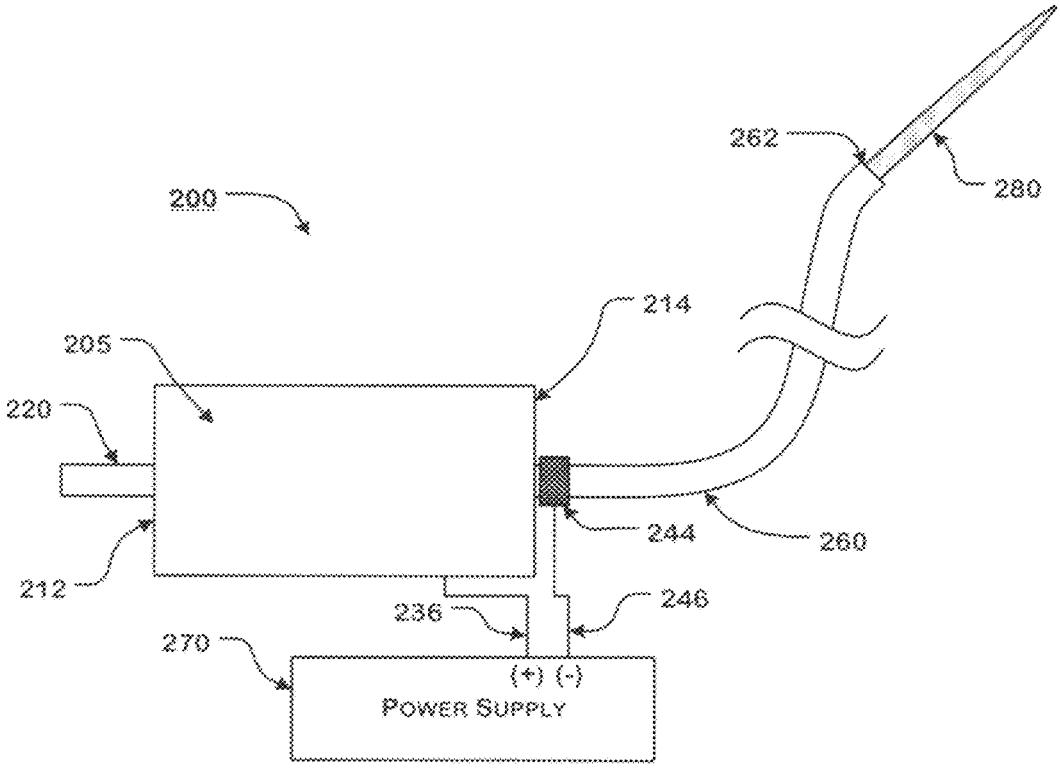
FIG. 2A shows a side view of a second illustrative, non-limiting embodiment of an exemplary plasma generator according to this invention.
Figure 2B:
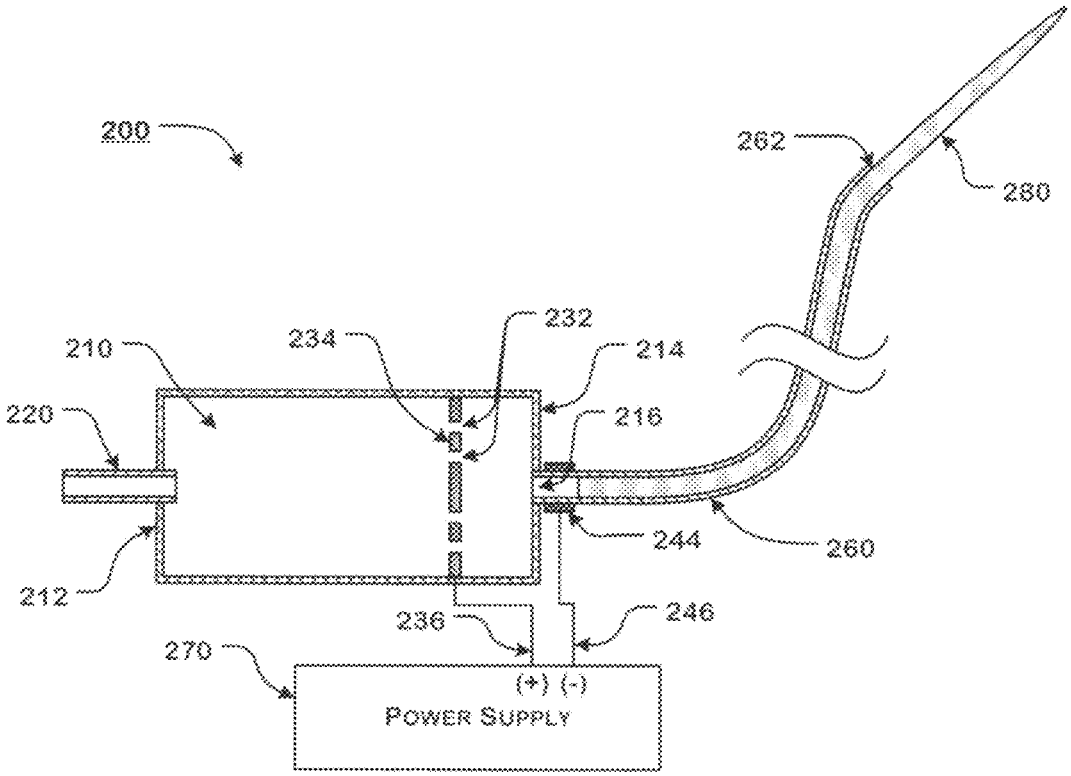
FIG. 2B shows a cross-sectional view of the second illustrative, non-limiting embodiment of an exemplary plasma generator according to this invention.

FIGS. 2A and 2B show a side and cross-sectional view, respectively, of a second illustrative, non-limiting embodiment of an exemplary plasma generator according to this invention. As illustrated in FIGS. 2A and 2B, the plasma generator 200 comprises a dielectric body 205 having a first wall portion 212 and a second wall portion 214 and defining a cavity 210.

One or more gas inlets 220 is/are located proximate the first wall portion 212 of the dielectric body 205 and is/are in fluid communication with the cavity 210 of the plasma generator 200. The one or more gas inlet(s) 220 may be located at the first wall portion 212 of the dielectric body 205 so as to allow gas to be injected into the cavity 210 approximately parallel to a longitudinal axis of the plasma generator 200, as illustrated, for example, in FIGS. 2A and 2B. Alternatively, the one or more gas inlet(s) 220 may be located proximate the first wall portion 212 so as to allow gas to be injected into the cavity 200 and approximately perpendicular to the longitudinal axis of the dielectric body 205, as illustrated by gas inlet 320 illustrated, for example, in FIGS. 3A and 3B. It should also be appreciated that the one or more gas inlet(s) 220 may be placed at any desired angle relative to the longitudinal axis of the dielectric body 205.

A discharge aperture 216 is formed through the second wall portion 214. A hollow discharge tube 260 is fitted within the discharge aperture 216 and extends from the second wall portion 214 to a discharge tube aperture 262. It should be appreciated that the size and shape of the discharge aperture 216 is a design choice based on the desired functionality of the plasma generator 200. Likewise, it should also be appreciated that the size, shape, length, and inner diameter of the discharge tube 260 are also a design choice based on the desired functionality of the plasma generator 200.

In various exemplary, non-limiting embodiments, the cavity 210 of the dielectric body 205 is hermetically sealed or closed, but for the gas inlet 220 and the discharge aperture 216.

At least one anode 234 is fitted or formed within or proximate the cavity 210 of the dielectric body 205. At least one cathode 244 is fitted or formed at least substantially around a portion of the discharge tube 260.

The anode 234 comprises an electrically conductive material, such as, for example, a metal, and includes one or more apertures 232 formed therethrough. The anode 234 is electrically coupled, via an electrical connection 236, to a power supply 270. In various exemplary embodiments, the end of 234 comprises a plate having one or more apertures 232 formed therethrough. Alternatively, the anode 234 may comprise a mesh or mesh-like formation of material wherein the apertures 232 are created by gaps between interwoven components of the anode 234.

The cathode 244 comprises an electrically conductive material, such as, for example, a metal. In various exemplary embodiments, the cathode 244 may be positioned external to the discharge tube 260 or may be embedded within the discharge tube 260. The cathode 244 is attached or coupled to or around the discharge tube 260 such that at least a portion of the discharge tube 260 isolates the cathode 244 from the interior of the discharge tube 260. Thus, any gas that flows through the discharge tube 260 is isolated from the cathode 244 such that the gas does not come into direct contact with the cathode 244.

The cathode 244 is electrically coupled, via an electrical connection 246, to the power supply 270.

In various exemplary, non-limiting embodiments, at least a portion of the dielectric body 205 and/or the discharge tube 260 may be formed of glass, Plexiglass, quartz, alumina, ceramic, or the like. Alternatively, at least a portion of the discharge tube 260 may be formed of polymerized siloxanes or other silicones or polysiloxanes, or synthetic or natural rubbers or other elastomers.

The material that comprises the dielectric body 205 and the discharge tube 260 may be the same material or may be a different material. It should also be appreciated that the dielectric body 205 and/or the discharge tube 260 may be formed of multiple materials. Thus, it should be understood that the material or materials used materials used to form the dielectric body 205 and/or the discharge tube 260 is a design choice based on the desired appearance, strength, and functionality of the plasma generator 200.

In various exemplary, non-limiting embodiments, the distance that separates the anode 234 from the cathode 244 is approximately 1-40 mm.

During use of the plasma generator 200, a carrier gas (or mixture) is injected proximate the first wall portion 212 of the dielectric body 205, via the one or more gas inlet(s) 220. In various exemplary embodiments, the carrier gas (or mixture) is injected into the plasma generator at a flow rate of approximately 1-10 l/min. In various exemplary, non-limiting embodiments, the gas or gas mixtures may comprise helium, a helium and oxygen mixture, argon, nitrogen, air, or other noble gases and/or their mixtures.

As the carrier gas (or mixture) is injected into the one or more gas inlet(s) 220, the gas flows through the cavity 210 of the dielectric body 205, through the aperture(s) 232 of the anode 234, through the discharge aperture 216, through the interior of the discharge tube 260, and finally through the discharge tube aperture 262 of the discharge tube 260.

In various exemplary embodiments, the carrier gas (or mixture) is injected into the plasma generator at a flow rate of approximately 1-10 ml/min. In various exemplary, non-limiting embodiments, the gas or gas mixtures may comprise helium, helium and oxygen, argon, nitrogen, air, or the like.

When power is applied to the anode 234 and the cathode 244, the injected gas breaks down and a plasma plume 280 is discharged through the discharge aperture 216, through the interior of the discharge tube 160, and finally through the discharge tube aperture 262 of the discharge tube 260.

The generated plasma plume 180 generally extends approximately 2 inches or more from the discharge tube aperture 262. The width of the plasma plume 280 is generally determined by the diameter or size of the discharge tube aperture 262. In aperture 262. In various exemplary embodiments, the diameter of the discharge tube aperture 262 is approximately 1 mm to a few millimeters.

If the discharge tube 260 is flexible, the plasma generator 200 allows a user to move or manipulated the discharge tube 260 so that the generated plasma plume 280 can be applied as desired by a user.

The generated plasma plume 280 is at room temperature and remains stable so long as appropriate power is applied to the anode 234 and the cathode 244 and the carrier gas is flowing.

In various exemplary, non-limiting embodiments, the power supply 270 can supply Alternating Current (AC), Radio Frequency (RF) power, or regulated voltage pulses of varying widths and of varying frequencies to the anode 234 and the cathode 244. In certain embodiments, the plasma generator 200 is driven by nanosecond/microsecond voltage pulses to, in turn, produce nanosecond/microsecond plasma plumes.

The power supply 270 may optionally supply the plasma generator 200 with a pulsed voltage having a magnitude from 2 kilovolts to 12 kilovolts, applied at a pulse width of between 200 nanoseconds to 5 microseconds, and/or applied at a frequency of 1 kilohertz to 10 kilohertz or higher.

In various exemplary, non-limiting embodiments, the power supply 270 supplies between 1-20 watts of power to the anode 234 and the cathode 244. It should be understood that, in various exemplary embodiments, the power supply 270 may supply up to several hundred watts of power to the anode 234 and the cathode 244. It should be appreciated that the frequency and amount of power supplied by the power supply 270 may be altered to produce a generated plasma plume 280 having a desired strength, functionality, size, and/or duration.

In various exemplary embodiments, the plasma plume 280 may measure 2 inches or more, while the width of the plasma plume 280 is generally determined by the diameter or size of the discharge aperture 216 and/or discharge tube aperture 262. 262. In various exemplary embodiments, the diameter of the discharge tube aperture 262 may be approximately a few millimeters to about 1 centimeter.

Figure 3A:
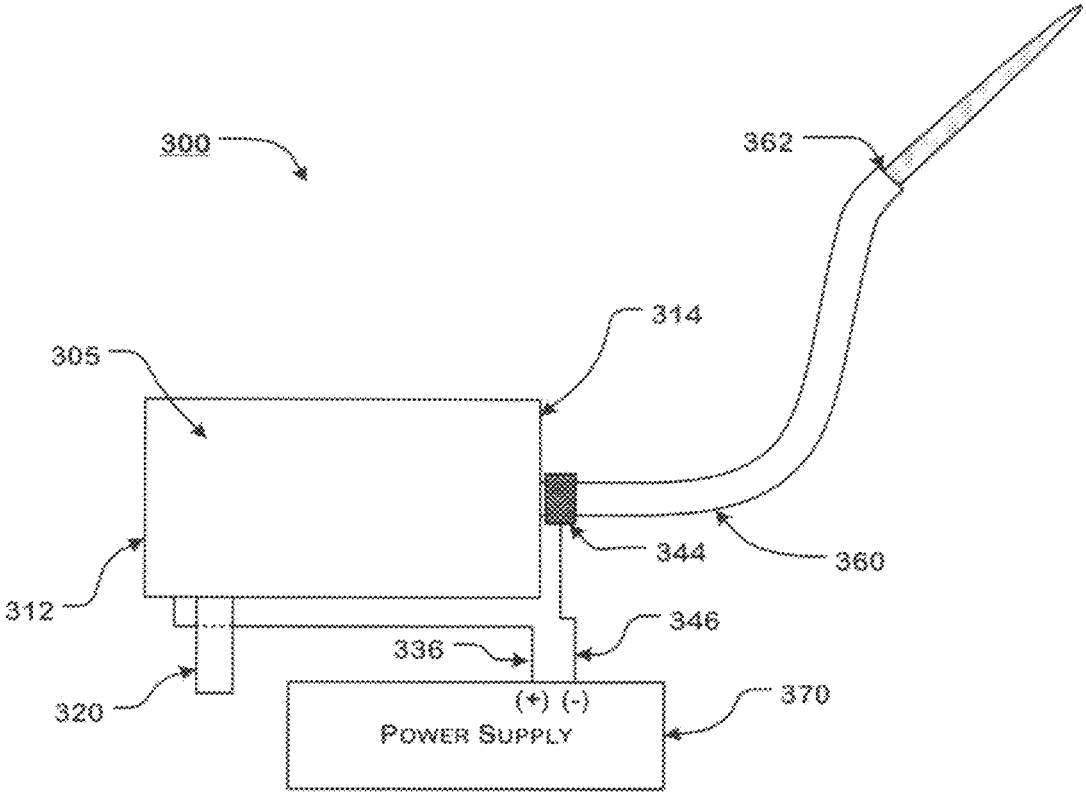
FIG. 3A shows a side view of a third illustrative, non-limiting embodiment of an exemplary plasma generator according to this invention.
Figure 3B:
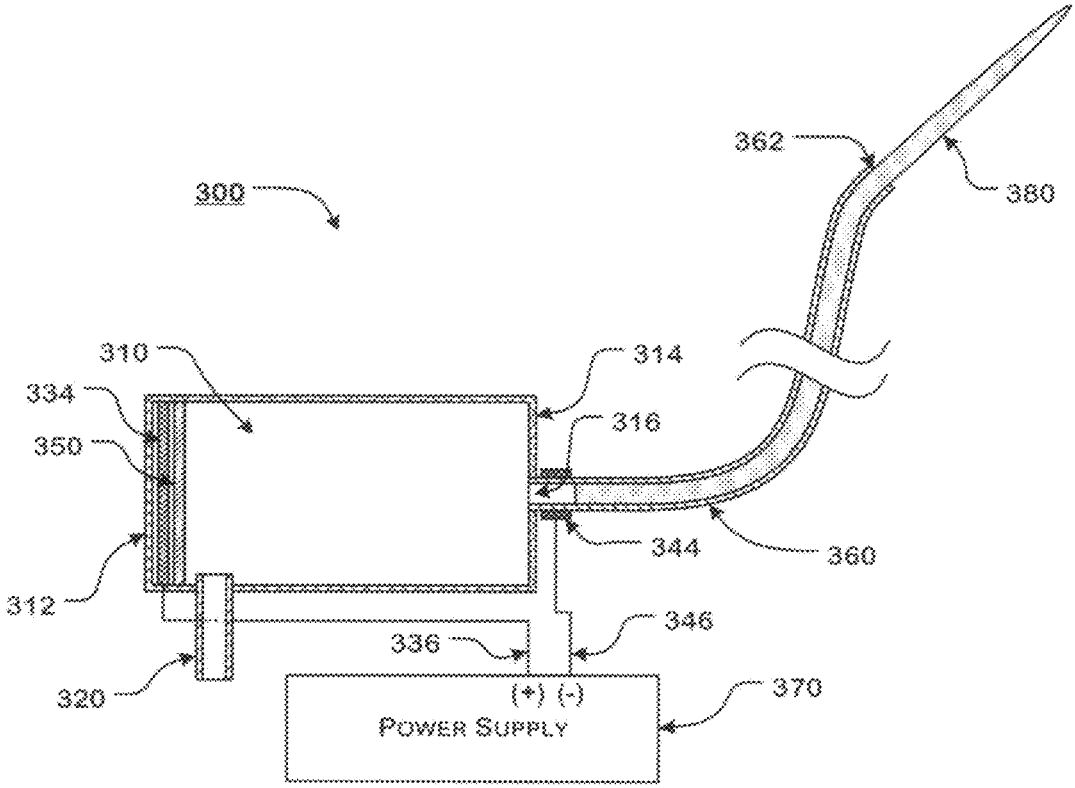
FIG. 3B shows a cross-sectional view of the third illustrative, non-limiting embodiment of an exemplary plasma generator according to this invention.

FIGS. 3A and 3B show a side view and a cross-sectional view, respectively, of a third illustrative, non-limiting embodiment of an exemplary plasma generator according to this invention. As illustrated in FIGS. 3A and 3B, the plasma generator 300 comprises a dielectric body 305 having a first wall portion 312, a second wall portion 314, a cavity 310, one or more gas inlet(s) 320, a discharge aperture 316, a hollow discharge tube 360 having a discharge tube aperture 362, a cathode 344 fitted or formed at least substantially around a portion of the discharge tube 360, and at least one anode 334, an electrical connection 336 electrically coupling the anode 334 to a power supply 370, and an electrical connection 346 electrically coupling the cathode 344 to the power supply 370.

It should be understood that each of these elements, if included, corresponds to and operates similarly to the dielectric body 205, the first wall portion 212, the second wall portion 214, the cavity 210, the one or more gas inlet(s) 220, the discharge aperture 216, the hollow discharge tube 260, the discharge tube aperture 262, the cathode 244 fitted or formed at least substantially around a portion of the discharge tube 260, the at least one anode 234 having one or more apertures 232 formed therethrough, the electrical connection 236 electrically coupling the anode 234 to the power supply 270, and the electrical connection 246 electrically coupling the cathode 244 to the power supply 270, as described above with reference to the plasma generator 200 of FIG. 2.

However, as illustrated in FIGS. 3A and 3B, the one or more gas inlet(s) 320 is illustrated as being approximately perpendicular to the longitudinal axis of the plasma generator 300.

Additionally, a dielectric plate 350 is attached or coupled within a cavity 310 such that the anode 334 is isolated from any gas within the chamber 310. Thus, during the use of the plasma generator 300, any gas that flows through the chamber 310 is isolated from the anode 334 such that the gas does not come into direct contact with the anode 334.

Figure 4A:
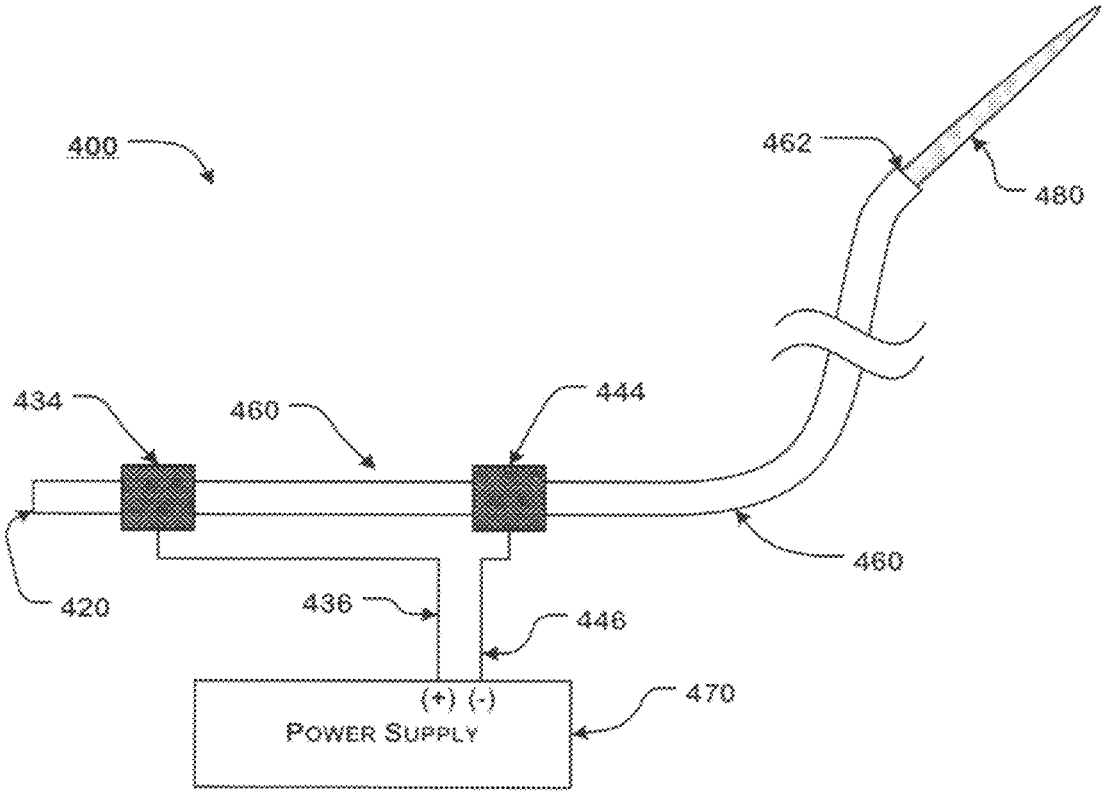
FIG. 4A shows a side view of a fourth illustrative, non-limiting embodiment of an exemplary plasma generator according to this invention.
Figure 4B:
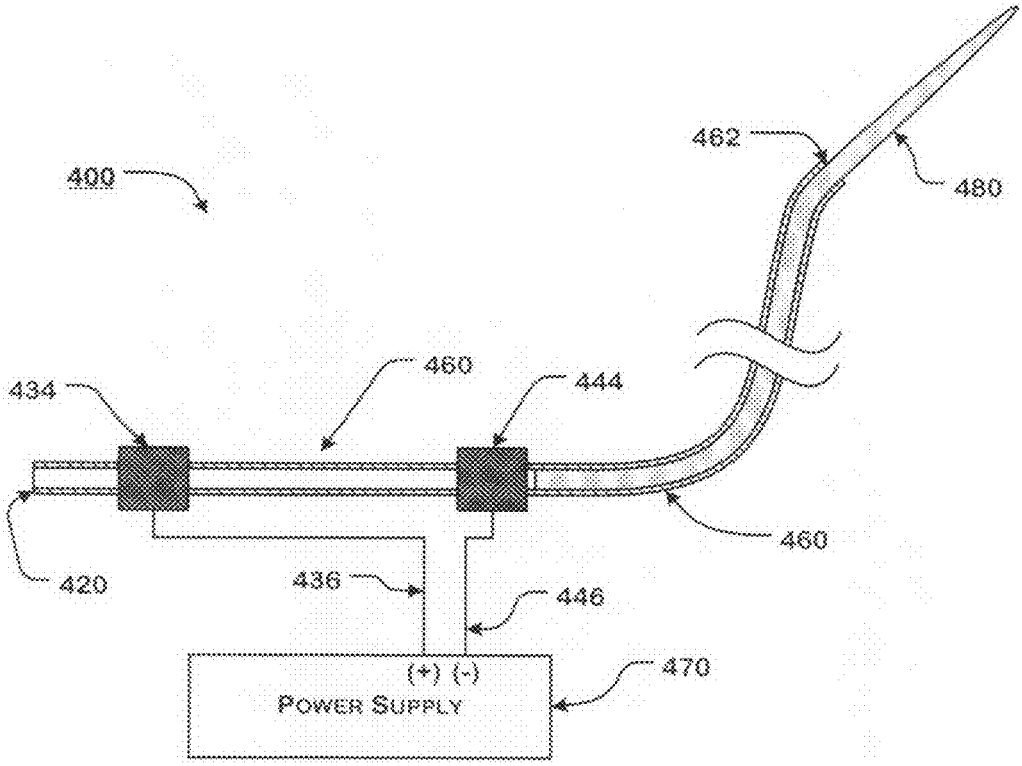
FIG. 4B shows a cross-sectional view of the fourth illustrative, non-limiting embodiment of an exemplary plasma generator according to this invention.

FIGS. 4A and 4B show a side and cross-sectional view, respectively, of a fourth illustrative, non-limiting embodiment of an exemplary plasma generator according to this invention. As illustrated in FIGS. 4A and 4B, the plasma generator 400 comprises a hollow discharge tube 460 extending from a gas inlet 420 to a discharge tube aperture 462.

It should also be appreciated that the size, shape, length, and inner diameter of the discharge tube 460 is a design choice based on the desired functionality of the plasma generator 400.

At least one anode 434 is attached or coupled to or around the discharge tube 460 such that at least a portion of the discharge tube 460 isolates the anode 434 from the interior of the discharge tube 460. Thus, any gas that flows through the discharge tube 460 is isolated from the anode 434 such that the gas does not come into direct contact with the anode 434.

The anode 434 comprises an electrically conductive material, such as, for example, a metal. In various exemplary embodiments, the anode 434 may be positioned external to the discharge tube 460 or may be embedded within the discharge tube 460. The anode 434 is electrically coupled, via an electrical connection 436, to the power supply 470.

At least one cathode 444 is attached or coupled to or around the discharge tube 460, spaced apart from the at least one anode 434 so as to avoid arcing between the cathode 444 and the anode 434. In various exemplary embodiments, an isolating material may be positioned between the cathode 444 and the anode 434 so as to provide electrical insulation between the cathode 444 and the anode 434.

At least a portion of the discharge tube 460 isolates the cathode 444 from the interior of the discharge tube 460. Thus, any gas that flows through the discharge tube 460 is isolated from the cathode 444 such that the gas does not come into direct contact with the cathode 444.

The cathode 444 comprises an electrically conductive material, such as, for example, a metal. In various exemplary embodiments, the cathode 444 may be positioned external to the discharge tube 460 or may be embedded within the discharge tube 460. The cathode 444 is electrically coupled, via an electrical connection 446, to the power supply 470.

In various exemplary, non-limiting embodiments, at least a portion of the discharge tube 460 may be formed of glass, Plexiglass, quartz, alumina, ceramic, or the like. Alternatively, at least a portion of the discharge tube 460 may be formed of polymerized siloxanes or other silicones or polysiloxanes, or synthetic or natural rubbers or other elastomers. The material that comprises the discharge tube 460 and discharge 400 may be the same material or may be a different material.

In various exemplary, non-limiting embodiments, the distance that separates the anode 434 from the cathode 444 is approximately 1-40 mm.

Figure 4C:
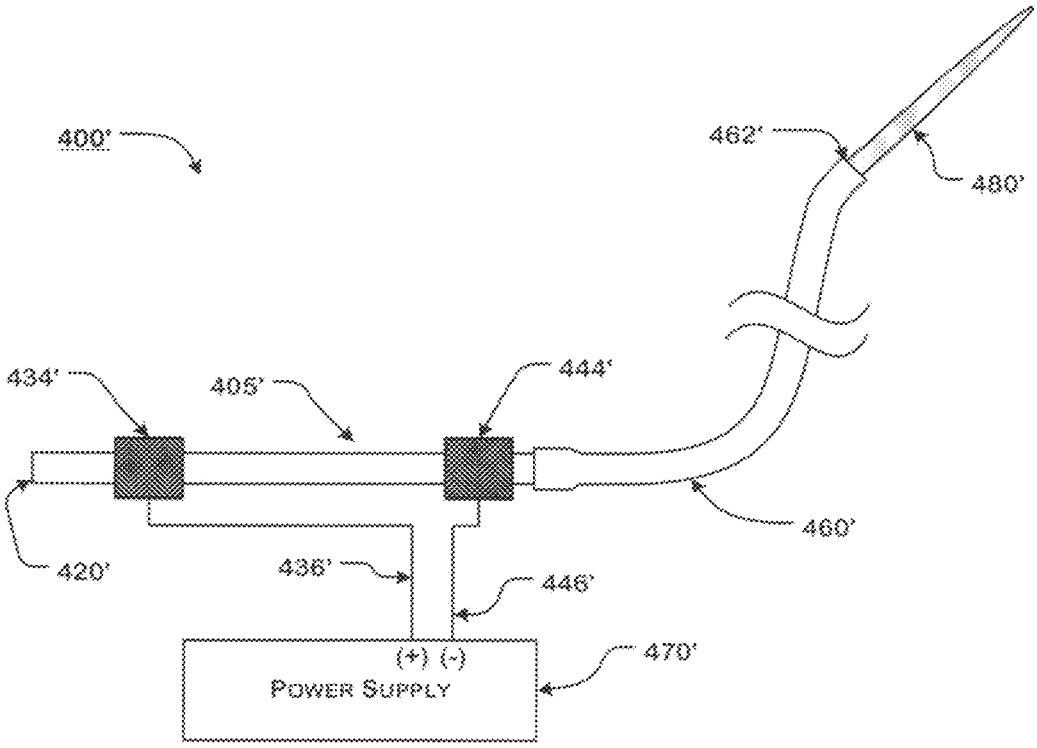
FIG. 4C shows a side view of a modified version of the exemplary plasma generator of FIGS. 4A and 4B according to this invention.
Figure 4D:
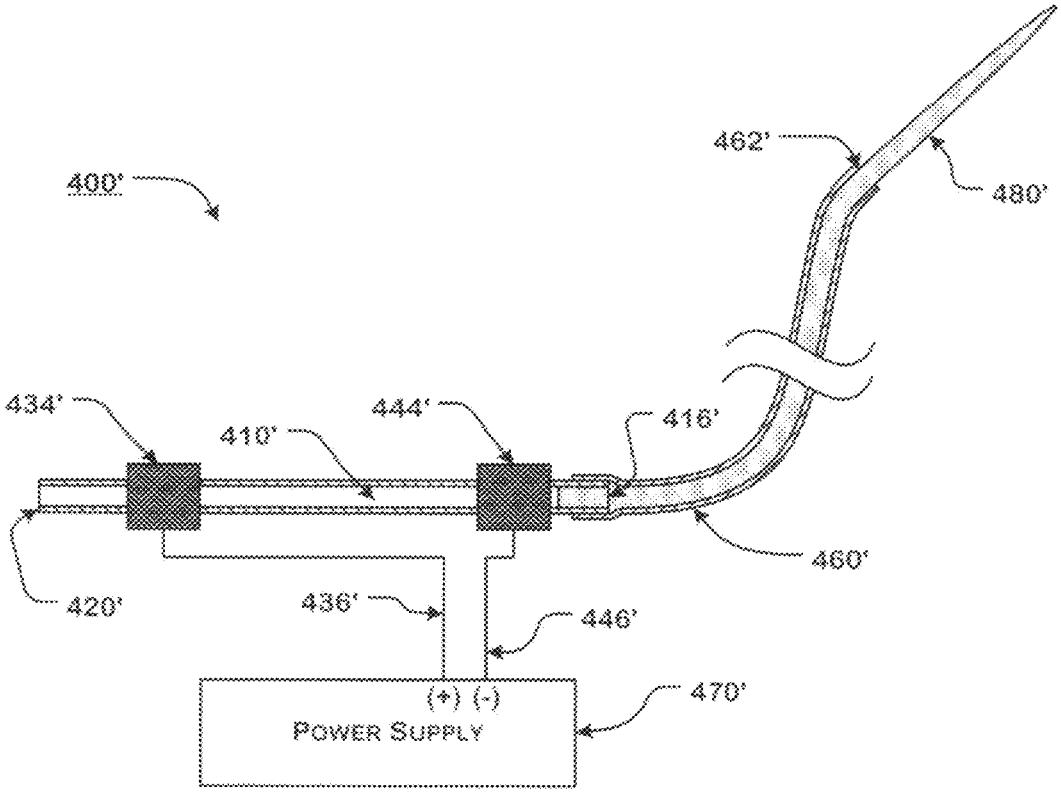
FIG. 4D shows a cross-sectional view of a modified version of the exemplary plasma generator of FIGS. 4A and 4B according to this invention.

As illustrated in FIGS. 4C and 4D, a dielectric tube portion 405' may be included that extends from a gas inlet 420' to a discharge aperture 416'. An anode 434' is formed at least substantially around a portion of the dielectric tube portion 405', a cathode 444' is formed at least substantially around a portion of the dielectric tube portion 405', and a discharge tube 460' is fitted, attached, or coupled to the dielectric tube portion 405'.

During use of the plasma generator 400 or 400', a carrier gas (or mixture) is injected into the gas inlet 420 or 420'. In various exemplary embodiments, the carrier gas (or mixture) is injected into the plasma generator 400 or 400' at a flow rate of approximately 1-10 l/min. In various exemplary, non-limiting embodiments, the gas or gas mixtures may comprise helium, a helium and oxygen mixture, argon, nitrogen, air, oxygen mixture, argon, nitrogen, air, or other noble gases and/or their mixtures.

As the carrier gas (or mixture) is injected into the gas inlet 420 or 420', the gas flows through the hollow discharge tube 460 or 460' and exits through the discharge tube aperture 462 or 462' of the discharge tube 460 or 460'.

When power is applied to the anode 434 or 434' and the cathode 444 or 444', in the manner described with respect to the plasma generator 200, the injected gas breaks down and a plasma plume 480 or 480' is launched through the portion of the discharge tube 460 or 460' proximate or after the cathode 444 or 444' and through the discharge tube aperture 462 or 462' of the discharge tube 460 or 460'.

Figure 5A:
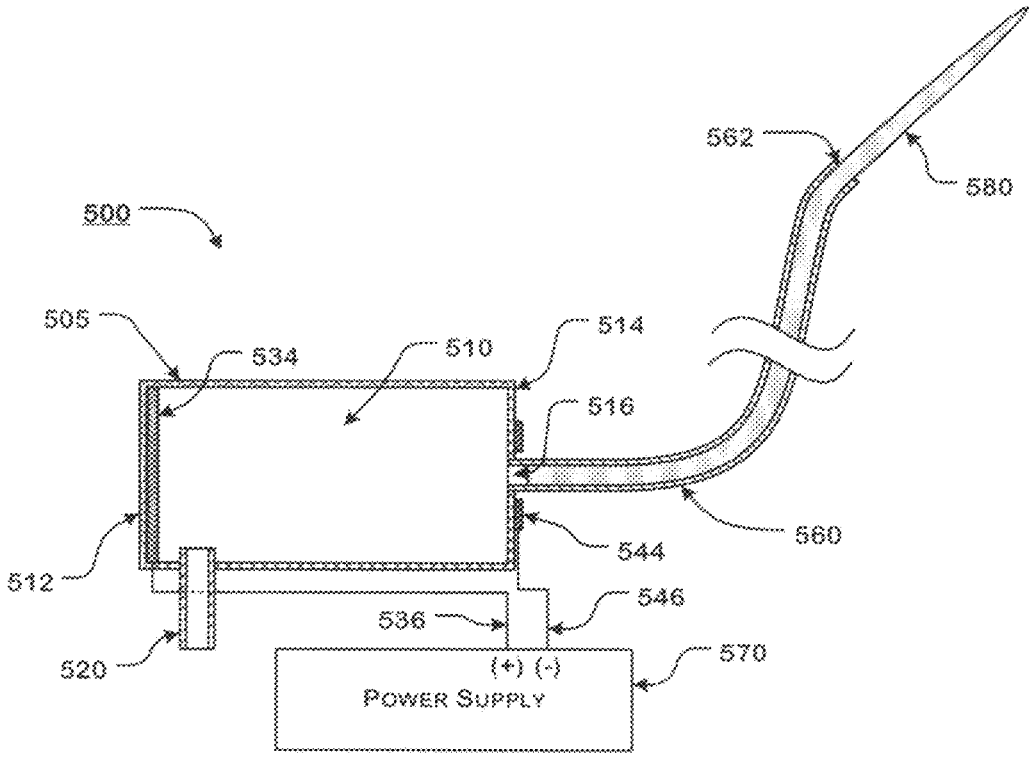
FIG. 5A shows a cross-sectional view of a fifth illustrative, non-limiting embodiment of an exemplary plasma generator according to this invention.
Figure 5B:
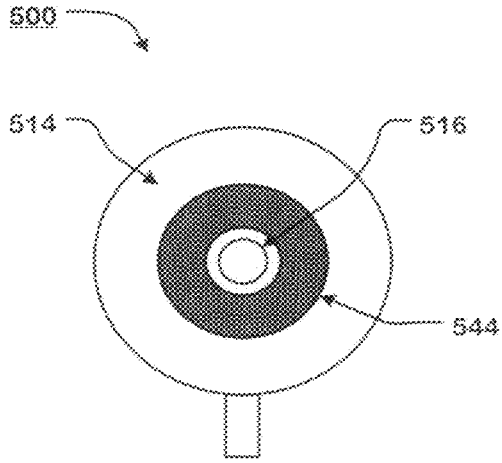
FIG. 5B shows a front view of the fifth illustrative, non-limiting embodiment of an exemplary plasma generator according to this invention.

FIGS. 5A and 5B show a cross-sectional view and a front view, respectively, of a fifth illustrative, non-limiting embodiment of an exemplary plasma generator according to this invention. As illustrated in FIGS. 5A and 5B, the plasma generator 500 comprises a dielectric body 505 having a first wall portion 512 and a second wall portion 514 and defining a cavity 510.

One or more gas inlets 520 is/are located proximate the first wall portion 512 of the dielectric body 505 and is/are in fluid communication with the cavity 510 of the plasma generator 500. The one or more gas inlet(s) 520 are located proximate the first wall portion 512 so as to allow gas to be injected into the cavity 500 and approximately perpendicular to the longitudinal axis of the plasma generator 500, as illustrated in FIGS. 5A and 5B. Alternatively, the one or more gas inlet(s) 520 may be located at the first wall portion 512 of the dielectric body 505 so as to allow gas to be injected into the cavity 510 approximately parallel to a longitudinal axis of the plasma generator 500, as illustrated, for example, in FIGS. 2A and 2B.

A discharge aperture 516 is formed through the second wall portion 514. It should be appreciated that the size and shape of the discharge aperture 516 is a design choice based on the desired functionality of the plasma generator 500.

In various exemplary, non-limiting embodiments, the cavity 510 of the dielectric body 505 is hermetically sealed or closed, but for the gas inlet 520 and the discharge aperture 516.

At least one anode 534 is fitted or formed within or proximate the cavity 510 of the dielectric body 505 proximate the first wall portion 512.

The anode 534 comprises an electrically conductive material, such as, for example, a metal, and may optionally include one or more apertures 532 formed therethrough. The anode 534 is electrically coupled, via an electrical connection 536, to a power supply 570. In various exemplary embodiments, the anode 534 comprises a plate. Alternatively, the anode 534 may comprise a mesh or mesh-like formation of material.

At least one cathode 544 is fitted or formed on the exterior side of the second wall portion 514, so is to be isolated from the cavity 510. The cathode 544 is formed so as to at least partially encircle the discharge aperture 516.

The cathode 544 comprises an electrically conductive material, such as, for example, a metal. In various exemplary embodiments, the cathode 544 may be positioned on the exterior of the second wall portion 514 or may be embedded within the second and 514. The cathode 544 is attached or coupled to the second wall portion 514 such that at least a portion of the second wall portion 514 isolates the cathode 544 from the cavity 510. Thus, any gas that flows through the cavity 510 is isolated from the cathode 544 such that the gas does not come into direct contact with the cathode 544, at least until the gas exits the discharge aperture 516.

The cathode 544 is electrically coupled, via an electrical connection 546, to the power supply 570.

An elongate discharge tube 560 is permanently or removably attached or coupled within the discharge aperture 516 such that when a generated plasma 580 is produced, the plasma 580 flows through the discharge aperture 516 and the discharge tube 560. In various exemplary embodiments, the discharge tube 560 is formed of a formed of a substantially flexible, non-conductive material. Alternatively, the discharge tube 560 may be formed of a substantially rigid, non-conductive material.

During use of the plasma generator 500, a carrier gas (or mixture) is injected proximate the first wall portion 512 of the dielectric body 505, via the one or more gas inlet(s) 520. As the carrier gas (or mixture) is injected into the one or more gas inlet(s) 520, the gas flows through the cavity 510 of the dielectric body 505, through the discharge aperture 516 of the second wall portion 514, through the interior of the discharge tube 560, and finally through the discharge tube aperture 562.

When power is applied to the anode 534 and the cathode 544, the injected gas breaks down and a plasma plume 580 is launched through the discharge aperture 516 of the second wall portion 514, through the interior of the discharge tube 560, and finally through the discharge tube aperture 562, as further described herein.

Figure 6:
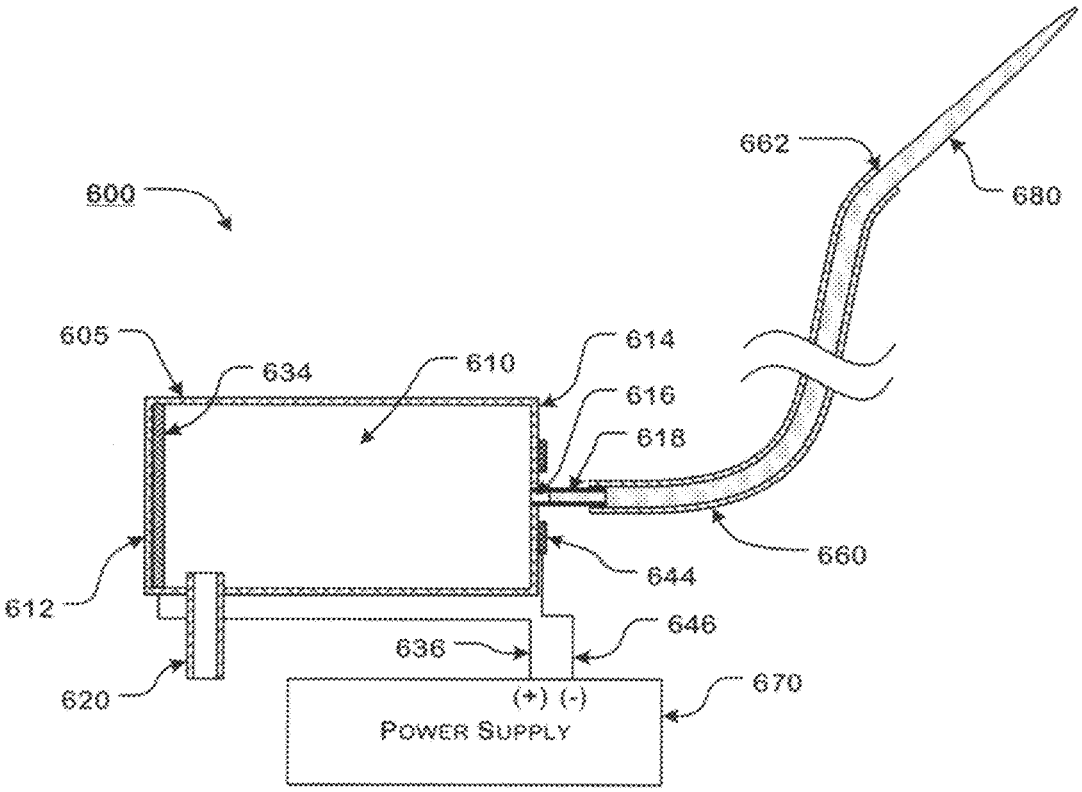
FIG. 6 shows a cross-sectional view of a sixth illustrative, non-limiting embodiment of an exemplary plasma generator according to this invention.

FIG. 6 shows a cross-sectional view of a sixth illustrative, non-limiting embodiment of an exemplary plasma generator according to this invention. As illustrated in FIG. 6, the plasma generator 600 comprises a dielectric body 605 having a first wall portion 612 and a second wall portion 614 and defining a cavity 610, one or more gas inlets 620, a discharge aperture 616, at least one anode 634 electrically coupled, via an electrical connection 636, to a power supply 670, at least one cathode 644 electrically coupled, via an electrical connection 646, to the power supply 670, and an elongate discharge tube 660 having a discharge tube aperture 662.

It should be understood that each of these elements, if included, corresponds to and operates similarly to the dielectric body 505, the first wall portion 512, the second wall portion 514, the cavity 510, the one or more gas inlets 520, the discharge aperture 516, the at least one anode 534, the electrical connection 536, the power supply 570, the at least one cathode 544, the electrical connection 546, the 546, the elongate discharge tube 560, and the discharge tube aperture 562, as described above with reference to the plasma generator 500 of FIG. 5.

However, as illustrated in FIG. 6, an extended tube portion 618 is attached or coupled within the discharge aperture 616 such that the elongate discharge tube 660 can be removably connected to the extended tube portion 618. In this manner, discharge tubes of varying lengths and or diameters can be utilized in connection with the plasma generator 600.

By allowing a discharge tube 660 to be removably attached to the extended tube portion 618, not only can alternate discharge tubes be utilized to allow a user to easily position a generated plasma plume, such as, for example, the plasma plume 680, in a particular direction so that the plasma plume can be utilized, but the plasma generator 600 can also more easily be used to clean and/or disinfect the interior of a tube that is connected to the extended tube portion 618.

As a generated plasma plume travels through any attached tube, whether the tube is an elongate discharge tube or another tube, the interior of the tube is cleaned or disinfected by the generated plasma. It should be appreciated that an extended tube portion, similar to the extended tube portion 618, can also be utilized in connection with any of the plasma generators 100-500 or 700.

Figure 7A:
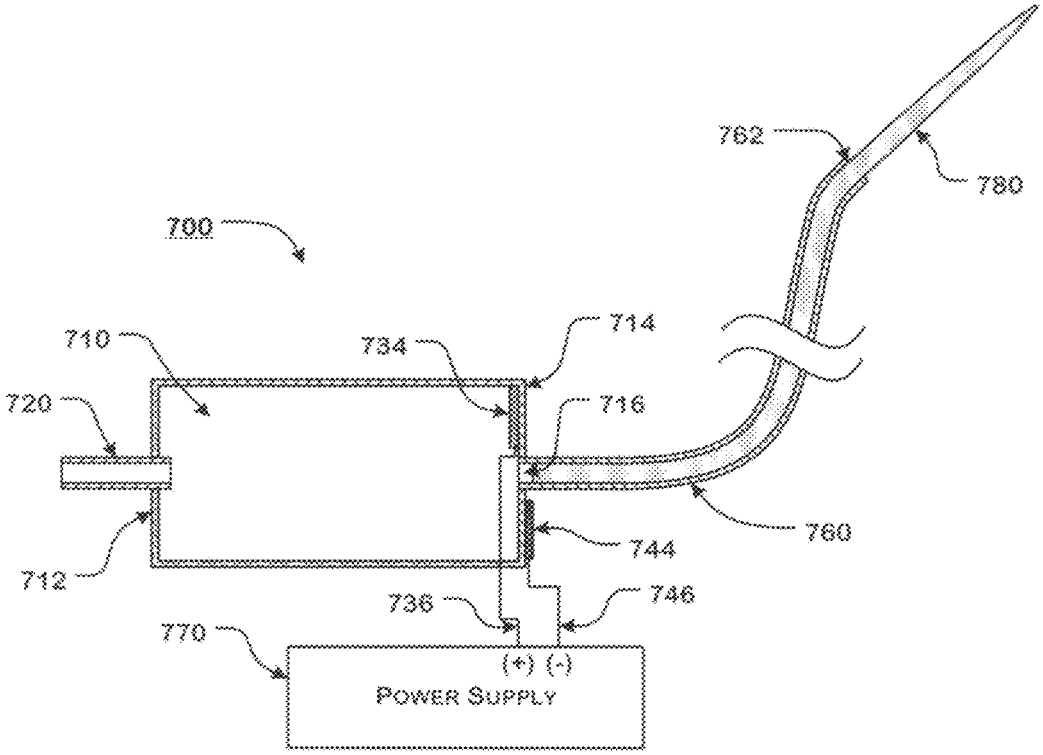
FIG. 7A shows a cross-sectional view of a seventh illustrative, non-limiting embodiment of an exemplary plasma generator according to this invention.
Figure 7B:
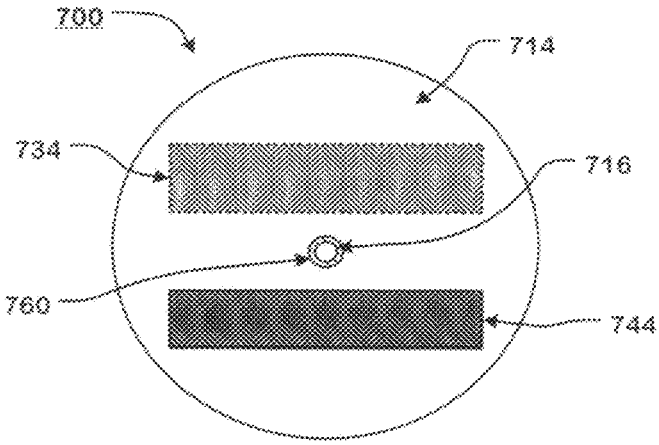
FIG. 7B shows a front view of the seventh illustrative, non-limiting embodiment of an exemplary plasma generator according to this invention.

FIGS. 7A and 7B show a cross-sectional view and a front view, respectively, of a seventh illustrative, non-limiting embodiment of an exemplary plasma generator according to this invention. As illustrated in FIGS. 7A and 7B, the plasma generator 700 comprises a dielectric body 705 having a first wall portion 712 and a second wall portion 714 and defining a cavity 710.

One or more gas inlets 720 is/are located proximate the first wall portion 712 of the dielectric body 705 and is/are in fluid communication with the cavity 710 of the plasma generator 700, as further described herein.

A discharge aperture 716 is formed through the second wall portion 714. It should be appreciated that the size, shape, and arrangement of the discharge aperture 716 is a design choice based on the desired functionality of the plasma generator 700.

In various exemplary, non-limiting embodiments, the cavity 710 of the dielectric body 705 is hermetically sealed or closed, but for the gas inlet(s) 720 and the discharge aperture 716.

At least one anode 734 is fitted or formed within or proximate the cavity 710 of the dielectric body 705 proximate the second wall portion 714.

The anode 734 comprises an electrically conductive material, such as, for example, a metal, and may optionally include one or more apertures formed therethrough. The anode 734 is electrically coupled, via an electrical connection 736, to a power supply 770. In various exemplary embodiments, the anode 734 comprises a strip or plate. Alternatively, the anode 734 may comprise a mesh or mesh-like formation of material.

At least one cathode 744 is fitted or formed on the exterior side of the second wall portion 714, so is to be isolated from the cavity 710. The cathode 744 is formed so as to at least partially encircle the discharge aperture 716.

The cathode 744 comprises an electrically conductive material, such as, for example, a metal. In various exemplary embodiments, the cathode 744 may be positioned on the exterior of the second wall portion 714 or may be embedded within the second wall portion 714. The cathode 744 is attached or coupled to the second wall portion 714 such that at least a portion of the second wall portion 714 isolates the cathode 744 from the cavity 710. Thus, any gas that flows through the cavity 710 is isolated from the cathode 744 such that the gas does not come into direct contact with the cathode 744, at least until the gas exits the discharge aperture 716.

The cathode 744 is electrically coupled, via an electrical connection 746, to the power supply 770.

An elongate discharge tube 760 is permanently or removably attached or coupled within the discharge aperture 716 such that when a generated plasma 780 is produced, the plasma 780 flows through the discharge aperture 716 and the discharge tube 760. In various exemplary embodiments, the discharge tube 760 is formed of a substantially flexible, non-conductive material. Alternatively, the discharge tube 760 may be formed of a substantially rigid, non-conductive material.

During use of the plasma generator 700, a carrier gas (or mixture) is injected proximate the first wall portion 712 of the dielectric body 705, via the one or more gas inlet(s) 720. As the carrier gas (or mixture) is injected into the one or more gas inlet(s) 720, the gas flows through the cavity 710 of the dielectric body 705, through the discharge aperture 716 of the second wall portion 714, through the interior of the discharge tube 760, and finally through the discharge tube aperture 762.

When power is applied to the anode 734 and the cathode 744, the injected gas breaks down and a plasma plume 780 is launched through the discharge aperture 716 of the second wall portion 714, through the interior of the discharge tube 760, and finally through the discharge tube aperture 762, as further described herein.

While this invention has been described in conjunction with the exemplary embodiments outlined above, it is evident that many alternatives, modifications, and variations will be apparent to those skilled in the art.

Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth invention, as set forth above, are intended to be illustrative, not limiting. Various changes, modifications, and/or adaptations may be made without departing from the spirit and scope of this invention.

What is claimed is:

1. A plasma generator for delivering a generated plasma to an area that is a distance from the area where the plasma is initially generated, comprising:

a dielectric tube portion extending from a first end to a second end;

a first wall portion attached or coupled to the first end of the dielectric tube portion and a second wall portion attached or coupled to the second end of the dielectric tube portion, wherein the first wall portion and the second wall portion are attached or coupled to the dielectric tube portion to define a cavity within the dielectric tube portion, and wherein the second wall portion includes at least one discharge aperture formed therein;

a gas inlet formed proximate the first wall portion of the dielectric tube portion;

an anode located within the cavity of the dielectric tube portion, wherein the anode is electrically coupled, via an electrical connection, to a power supply;

a cathode coupled to the second wall portion proximate the at least one discharge aperture, wherein the cathode is electrically coupled, via an electrical connection, to the power supply; and an elongate discharge tube attached or coupled within the discharge aperture such that when a generated plasma is produced, the generated plasma flows through the discharge tube.

2. The plasma generator of claim 1, wherein the gas inlet is formed through the first wall portion.

3. The plasma generator of claim 1, wherein the gas inlet is formed through the dielectric tube portion.

4. The plasma generator of claim 1, wherein the anode includes at least one aperture formed therein.

5. The plasma generator of claim 1, wherein the anode is embedded within a dielectric disk located within the cavity of the dielectric tube portion, wherein the at least one dielectric disk includes at least one dielectric aperture formed therein.

6. The plasma generator of claim 5, wherein the anode includes at least one aperture formed therein, therein the at least one aperture corresponds to the at least one dielectric aperture formed in the at least one dielectric disk.

7. The plasma generator of claim 1, wherein the discharge aperture is formed proximate a center of the second wall portion.

8. The plasma generator of claim 1, wherein the cathode is embedded within the second wall portion.

9. The plasma generator of claim 1, wherein the cathode is coupled to the second wall portion such that the cathode at least partially surrounds the discharge aperture.

10. The plasma generator of claim 1, wherein the first wall portion and the second wall portion each comprise a dielectric material.

11. The plasma generator of claim 1, wherein the at least one dielectric disk is spaced apart from the second wall portion by approximately 1-40 mm.

12. The plasma generator of claim 1, wherein the diameter of the dielectric aperture is approximately 1-5 mm.

13. The plasma generator of claim 1, wherein the elongate discharge tube includes a plurality of apertures formed in the elongate discharge tube such that a plurality of plasma plumes extend from the elongate discharge tube.

14. The plasma generator of claim 1, wherein the plurality of apertures are formed around a circumference of the elongate discharge tube.

15. A plasma generator for delivering a generated plasma to an area that is a distance from the area where the plasma is initially generated, comprising:

a dielectric tube portion extending from a first end to a second end;

a first wall portion attached or coupled to the first end of the dielectric tube portion and a second wall portion attached or coupled to the second end of the dielectric tube portion, wherein the first wall portion and the second wall portion are attached or coupled to the dielectric tube portion to define a cavity within the dielectric tube portion, and wherein the second wall portion includes at least one discharge aperture formed therein;

a gas inlet formed proximate the first wall portion of the dielectric tube portion;

an anode located within the cavity of the dielectric tube portion, wherein the anode is electrically coupled, via an electrical connection, to a power supply;

an elongate discharge tube attached or coupled to the discharge aperture such that when a generated plasma is produced, the generated plasma flows through the discharge tube; and a cathode formed at least substantially around a portion of the discharge tube, wherein the cathode is electrically coupled, via an electrical connection, to the power supply.

16. The plasma generator of claim 15, wherein the gas inlet is formed through the first wall portion.

17. The plasma generator of claim 15, wherein the gas inlet is formed through the dielectric tube portion.

18. The plasma generator of claim 15, wherein the anode includes at least one aperture formed therein.

19. The plasma generator of claim 15, wherein the anode is embedded within a dielectric disk located within the cavity of the dielectric tube portion, wherein the at least one dielectric disk includes at least one dielectric aperture formed therein.

20. The plasma generator of claim 19, wherein the anode includes at least one aperture formed therein, therein the at least one aperture corresponds to the at least one dielectric aperture formed in the at least one dielectric disk.

21. The plasma generator of claim 15, wherein the discharge aperture is formed proximate a center of the second wall portion.

22. The plasma generator of claim 15, wherein the cathode is embedded within the discharge tube.

23. The plasma generator of claim 15, wherein the first wall portion and the second wall portion each comprise a dielectric material.

24. The plasma generator of claim 15, wherein the at least one dielectric disk is spaced apart from the second wall portion by approximately 1-40 mm.

25. The plasma generator of claim 15, wherein the diameter of the dielectric aperture is approximately 1-5 mm.

26. The plasma generator of claim 15, wherein the elongate discharge tube includes a plurality of apertures formed in the elongate discharge tube such that a plurality of plasma plumes extend from the elongate discharge tube.

27. The plasma generator of claim 26, wherein the plurality of apertures are formed around a circumference of the elongate discharge tube.

* * * * *